US007921531B2

(12) United States Patent
Prine et al.

(10) Patent No.: US 7,921,531 B2
(45) Date of Patent: Apr. 12, 2011

(54) PNEUMATIC BATTERING RAM AND METHOD THEREFOR

(76) Inventors: Lindell David Prine, Winslow, AZ (US); Jearld Wayne Prine, Winslow, AZ (US)

( * ) Notice: Subject to any disclaimer, the term of this patent is extended or adjusted under 35 U.S.C. 154(b) by 349 days.

(21) Appl. No.: 12/243,900

(22) Filed: Oct. 1, 2008

(65) Prior Publication Data

US 2010/0077585 A1 Apr. 1, 2010

Related U.S. Application Data

(63) Continuation-in-part of application No. 11/842,869, filed on Aug. 21, 2007, now abandoned.

(51) Int. Cl.
*A62B 3/00* (2006.01)

(52) U.S. Cl. ..... 29/252; 29/275; 173/90; 254/93 R

(58) Field of Classification Search ..... 29/252, 29/275, 254, 270, 244; 254/93 R; 173/90, 173/91, 128
See application file for complete search history.

(56) References Cited

U.S. PATENT DOCUMENTS

| | | | | |
|---|---|---|---|---|
| 3,710,655 | A * | 1/1973 | Brandle | 81/463 |
| 4,681,171 | A * | 7/1987 | Kee et al. | 173/90 |
| 5,329,685 | A * | 7/1994 | Gillespie | 29/254 |
| 5,769,394 | A * | 6/1998 | Yirmiyahu et al. | 254/93 R |
| 5,987,723 | A * | 11/1999 | McNally et al. | 29/254 |
| D570,655 | S * | 6/2008 | Meagher et al. | D8/14 |
| 7,565,711 | B1 * | 7/2009 | Schamadan | 7/145 |
| 2005/0246974 | A1 * | 11/2005 | Anderson | 52/155 |
| 2007/0261870 | A1 * | 11/2007 | Milone | 173/90 |
| 2009/0000097 | A1 * | 1/2009 | Dapkins et al. | 29/275 |
| 2010/0077585 | A1 * | 4/2010 | Prine et al. | 29/252 |

* cited by examiner

*Primary Examiner* — Lee D Wilson
(74) *Attorney, Agent, or Firm* — Veronica-Adele R. Cao; Weiss & Moy, P.C.

(57) ABSTRACT

A pneumatic battering ram is disclosed. The battering ram has a housing, a pressurized air tank, a ramming head, and a pivotable ramming edge. Air released from the air tank into the housing forces the ramming head outward against an enclosure to forcibly open it. Where a slug is inserted into the housing, air released from the pressurized air tank into the housing causes the slug to hit the inner surface of the ramming head, forcing it outwardly against the enclosure.

18 Claims, 10 Drawing Sheets

PNEUMATIC BATTERING RAM AND METHOD THEREFOR

CROSS-REFERENCE TO RELATED APPLICATION

This is a continuation-in-part of U. S. patent application Ser. No. 11/842,869 filed Aug. 21, 2007 in the name of the Applicants, to which priority is claimed.

FIELD OF THE INVENTION

This invention relates generally to devices used for forcible entry, and more specifically, to a pneumatic battering ram.

BACKGROUND OF THE INVENTION

Locked, fortified, blocked, or barricaded doors and passages oftentimes need to be forcibly opened. For example, law enforcement officers may need to forcibly enter a building to prevent the commission of a crime or to prevent the destruction of evidence. As another example, firemen and emergency rescue teams may need to forcibly enter a building in order to rescue people that are trapped within.

A battering ram is often used to gain entry into these locked buildings. The most common form of battering ram is a manually actuated ram. However, these battering rams are typically very heavy and require more than one person to swing the battering ram against the closure. Furthermore, many hits with these battering rams are required to break through a door, thus allowing criminals ample time to escape, to destroy evidence, or to arm themselves with weapons against the entering law enforcement officers. In an emergency situation such as a fire, every extra second that it takes for the battering ram to penetrate the door is an extra second that the flames will spread. Other devices for forcing doors open, like that disclosed in Yirmiyahu et al. (U.S. Pat. No. 4,783,053) require painstaking set-up. These types of devices are not useful in emergency situations.

Currently used battering rams are also insufficient when the user is too tall or too short or has to stand at a level higher or lower than the enclosure (e.g. on stairs). In order for the current battering rams like the one that is disclosed in Sabates et al. (U.S. Pat. No. 6,889,591) to work effectively, they have to be held at a right angle to the enclosure.

Other devices that require a conventional firearm or some other explosive device to be fired have also been used to forcibly open doors. However, these devices are dangerous because of the high possibility that a live round may be accidentally loaded into the firearm instead of a blank. Therefore, a need exists for a battering ram that is capable of forcibly opening a locked door with only one hit. The battering ram should also be safer than those forcible entry devices that are powered by firearms or explosive devices. The battering ram should also be able to rest flush against the enclosure despite a user being too tall or too short or despite the user having to stand at a level higher or lower than the enclosure.

SUMMARY OF THE INVENTION

An object of the present invention is to provide a battering ram that is capable of forcibly opening a locked door with only one hit.

Another object of the present invention is to provide a pneumatic battering ram that does not require the use of a firearm or explosive for its operation.

Another object of the present invention is to provide a battering ram that may be easily operated by one person.

Another object of the present invention is to be-able to provide a battering ram that will rest flush against the enclosure despite whatever angle the battering ram is held at in relation to the enclosure.

BRIEF DESCRIPTION OF THE PREFERRED EMBODIMENTS

In accordance with one embodiment of the present invention, a pneumatic battering ram is disclosed. The battering ram comprises a housing, a pressurized air tank coupled to one end of the housing, a ramming head slidably coupled to the other end of the housing, a ramming edge pivotably coupled to the ramming head, and a hinge mechanism connecting the ramming edge to the ramming head for allowing the ramming edge to remain flush against an enclosure when the housing is held at varying angles relative to the enclosure.

In accordance with another embodiment of the present invention, a pneumatic battering ram is disclosed. The pneumatic battering ram comprises a cylindrical housing, a pressurized air tank coupled to a proximal end of the housing, a cylindrical slug within the housing that slides along the length of the housing, a cylindrical ramming head slidably coupled to a distal end of the housing, a rectangular ramming edge pivotably bolted to a distal end of the ramming head, wherein a distal side of the ramming edge has a plurality of teeth for penetrating the enclosure, a bolt assembly coupling a middle portion of the ramming edge perpendicularly to the ramming head, wherein the bolt assembly comprises two spaced apart plates coupled to the distal end of the ramming head, each plate defining an aperture, a bolt passing through the aperture of each plate and through an aperture defined by the middle portion of the ramming edge, and a nut to secure the bolt in place.

In accordance with another embodiment of the present invention, a battering ram is disclosed. The battering ram comprises a housing, a pressurized air tank coupled to one end of the housing, a ramming head slidably coupled to the other end of the housing, a ramming edge pivotably bolted to the ramming head, a slug within the housing that slides along the length of the housing, and at least one aperture defined by the ramming head that aligns with at least one aperture defined by the housing for releasing excess air from the housing when air is released from the air tank and the slug slides toward the ramming head.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
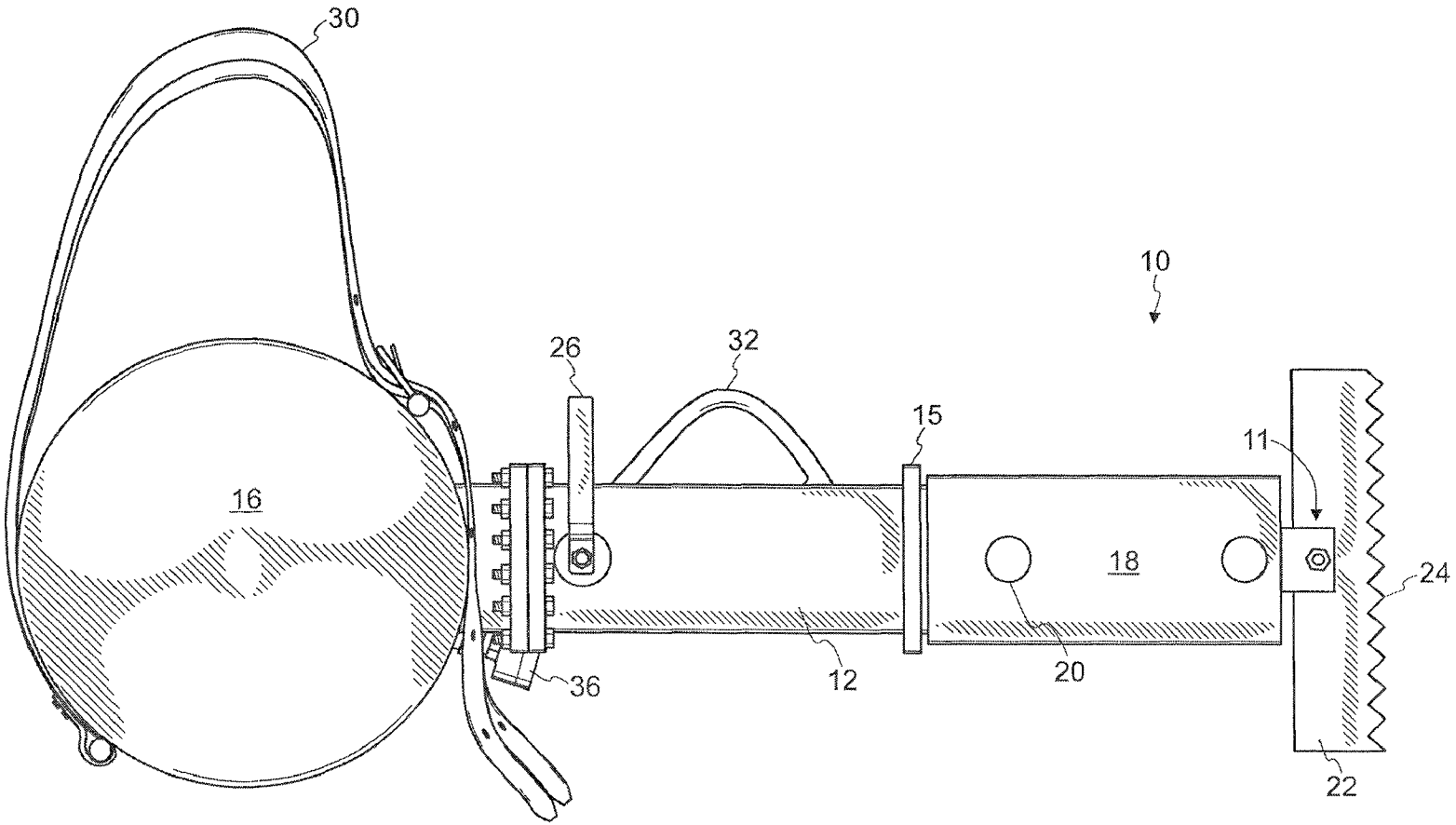
FIG. 1 is a right side view of an embodiment of the battering ram of the present invention.
Figure 2:
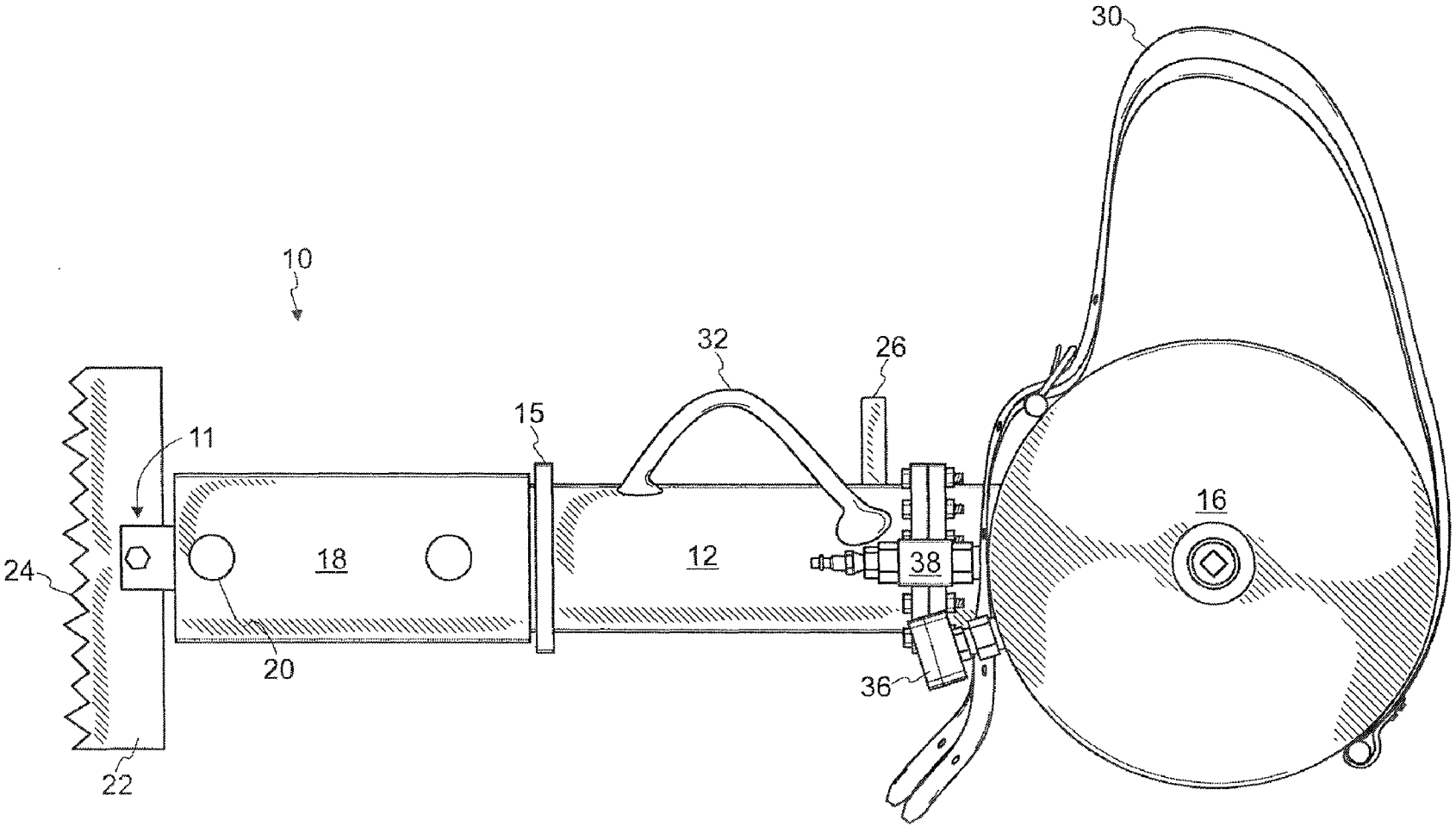
FIG. 2 is a left side view of the battering ram of FIG. 1.
Figure 4:
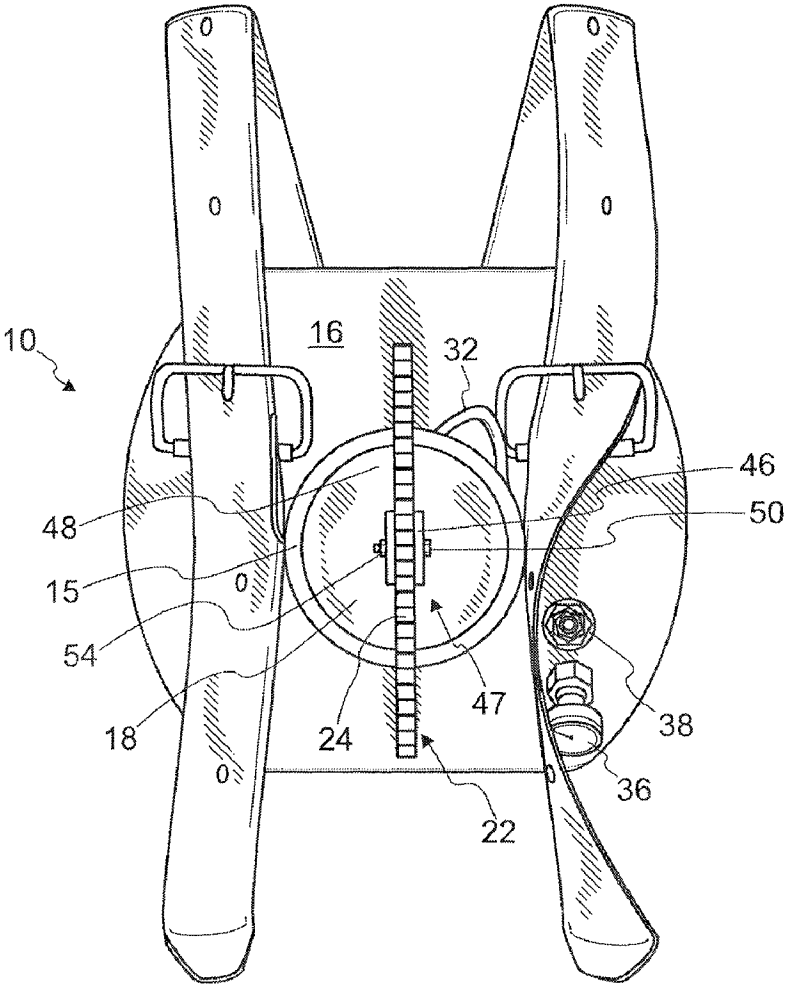
FIG. 4 is a front view of the battering ram of FIG. 1.
Figure 3:
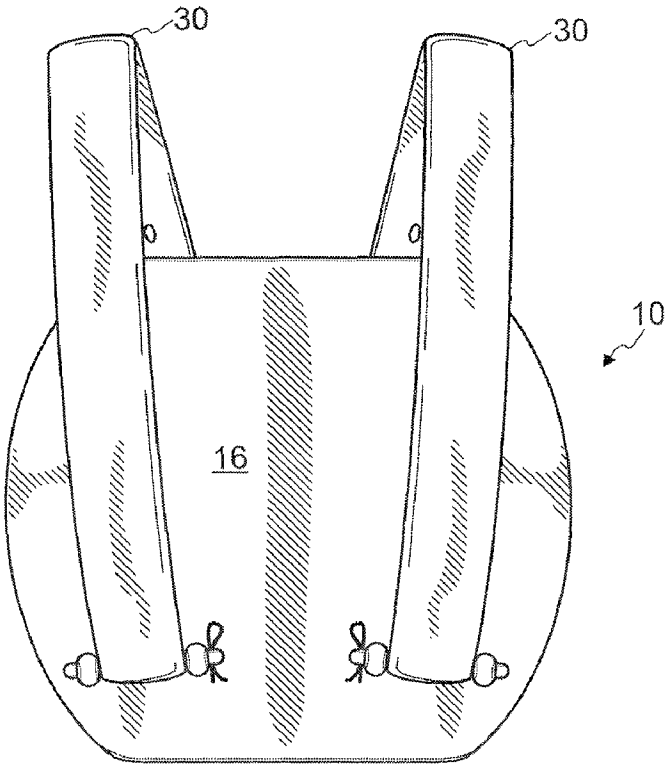
FIG. 3 is a rear view of the battering ram of FIG. 1.
Figure 5:
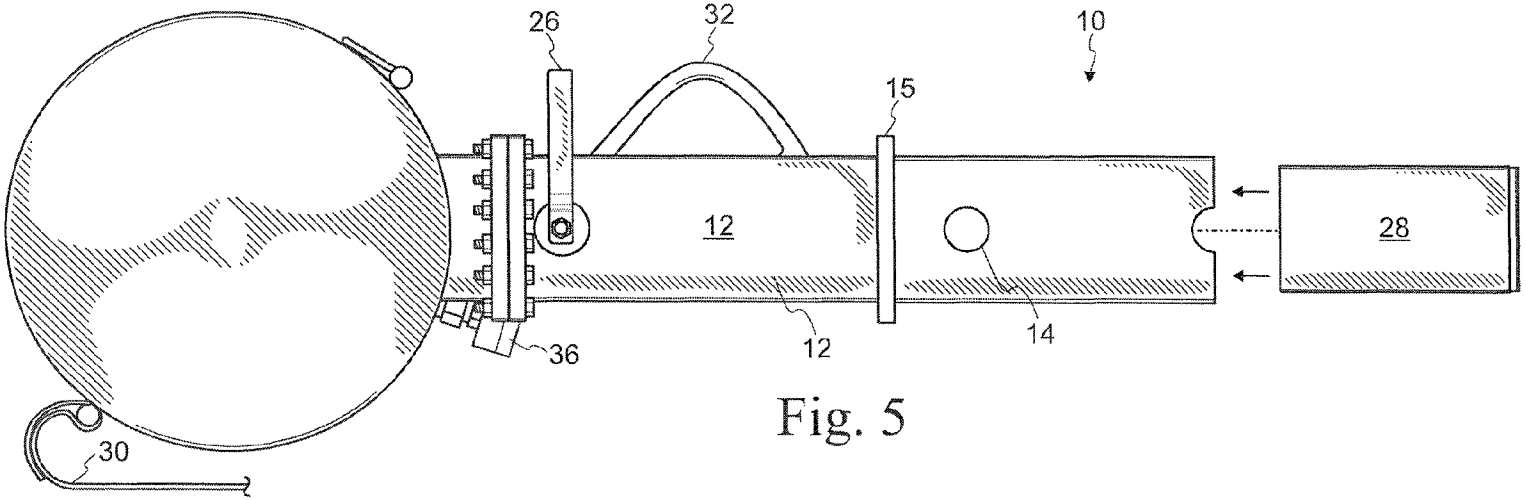
FIG. 5 is a right side view of the battering ram of FIG. 1 shown with a slug being placed into the housing.
Figure 6:
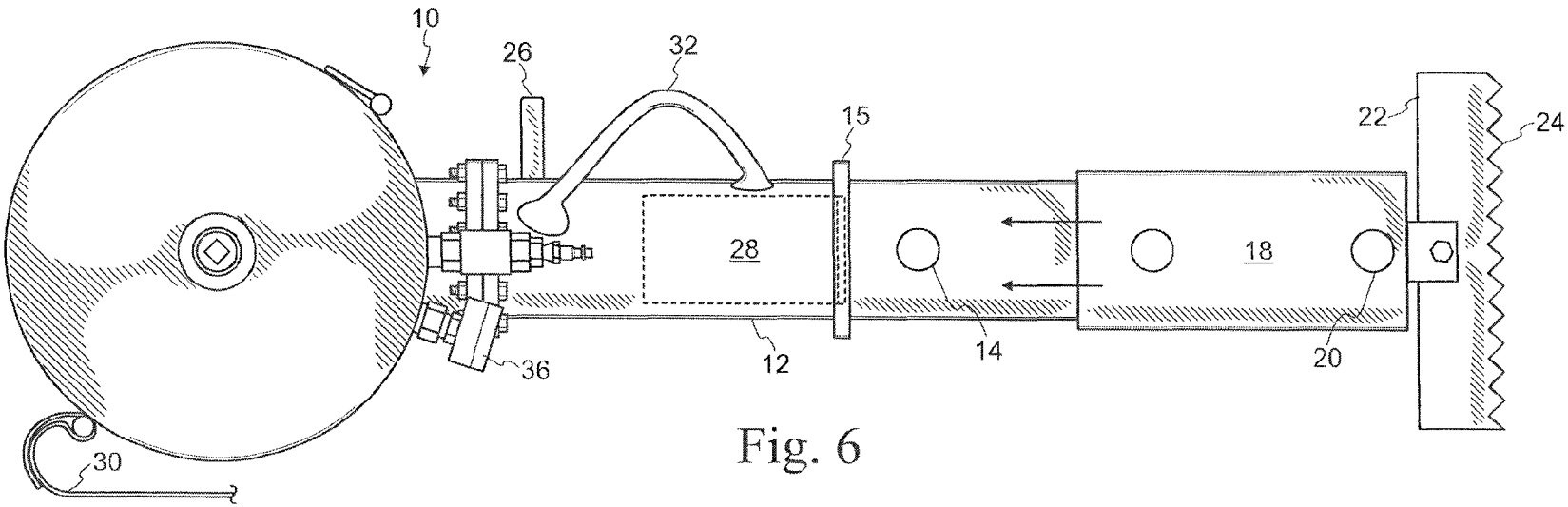
FIG. 6 is a left side view of the battering ram of FIG. 1 shown with the piston and ramming edge being placed onto the housing.
Figure 7:
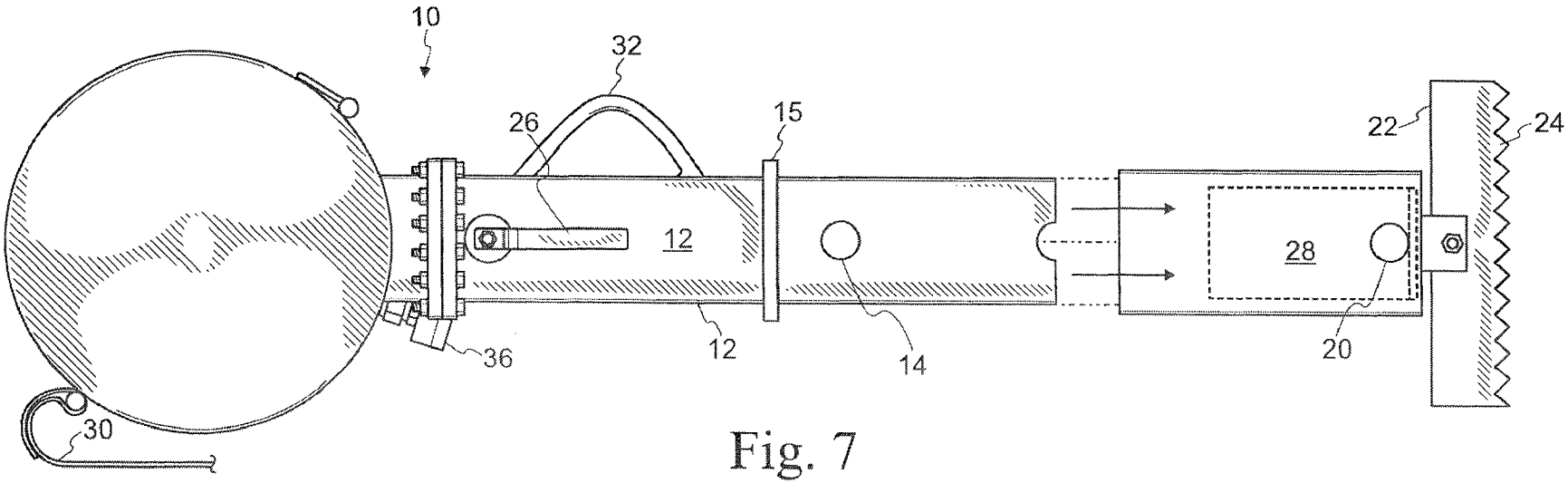
FIG. 7 is a right side view of the battering ram of FIG. 1, shown with the slug being deployed and forcing the piston and ramming edge forward.
Figure 10:
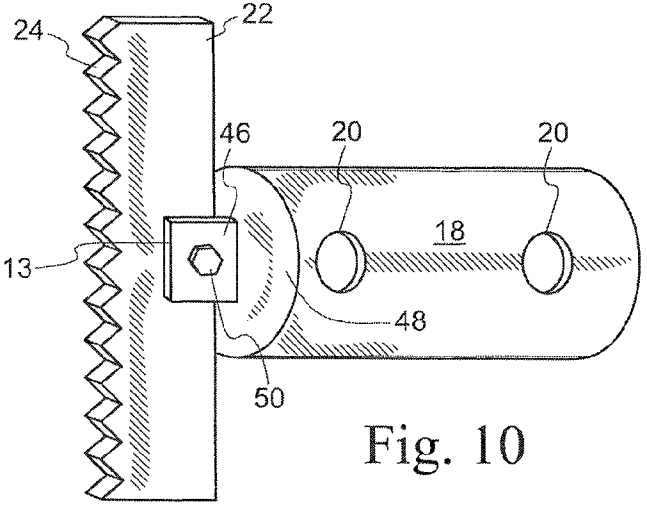
FIG. 10 is a front perspective view of the piston and ramming edge.
Figure 9:
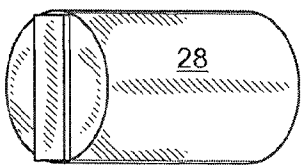
FIG. 9 is a front perspective view of the slug of FIG. 8.
Figure 8:
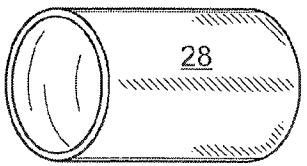
FIG. 8 is a rear perspective view of the slug.
Figure 11:
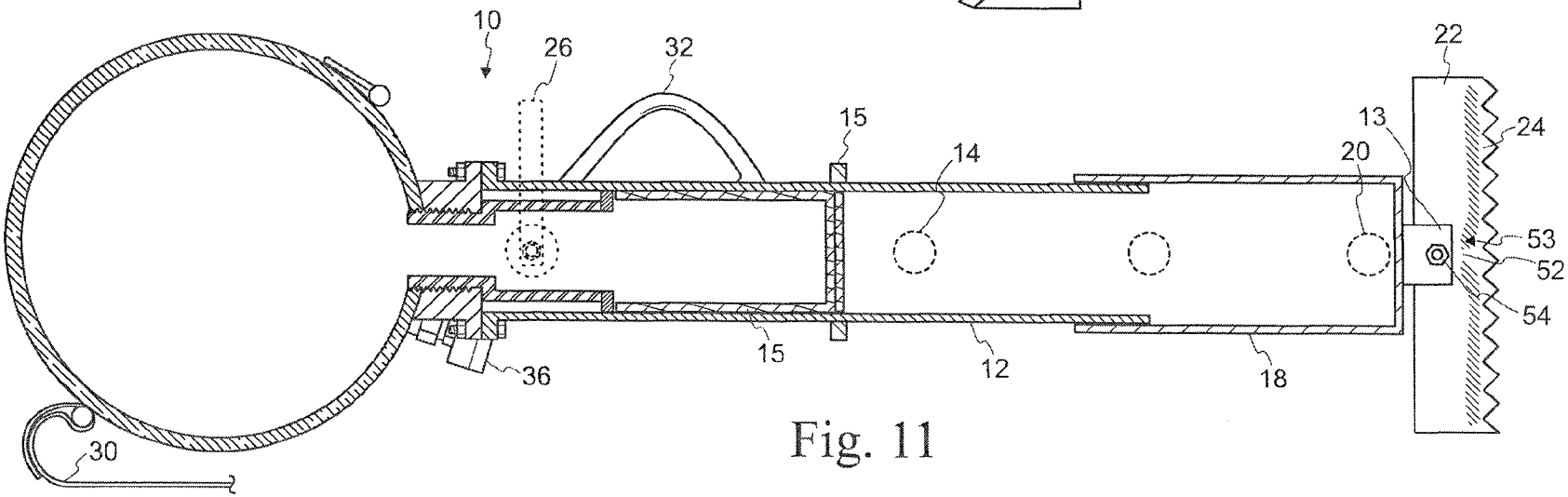
FIG. 11 is a right side cross-sectional view of the battering ram of FIG. 1, shown with the piston and ramming edge being placed onto the housing.
Figure 12:
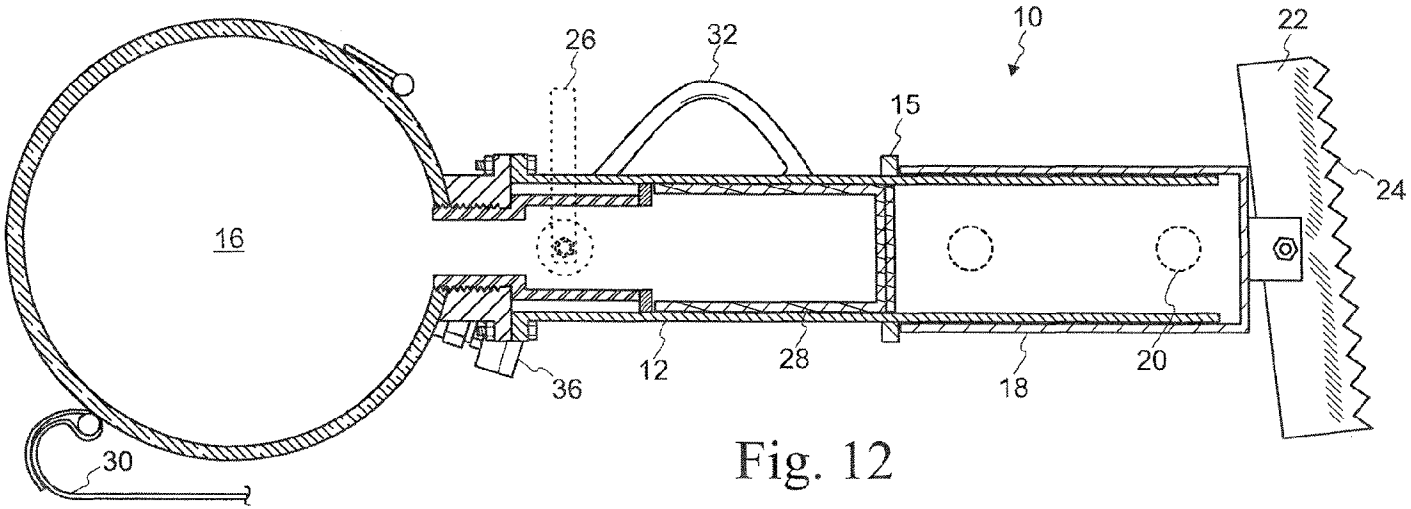
FIG. 12 is a right side cross-sectional view of the battering ram of FIG. 1, shown in a ready position.
Figure 13:
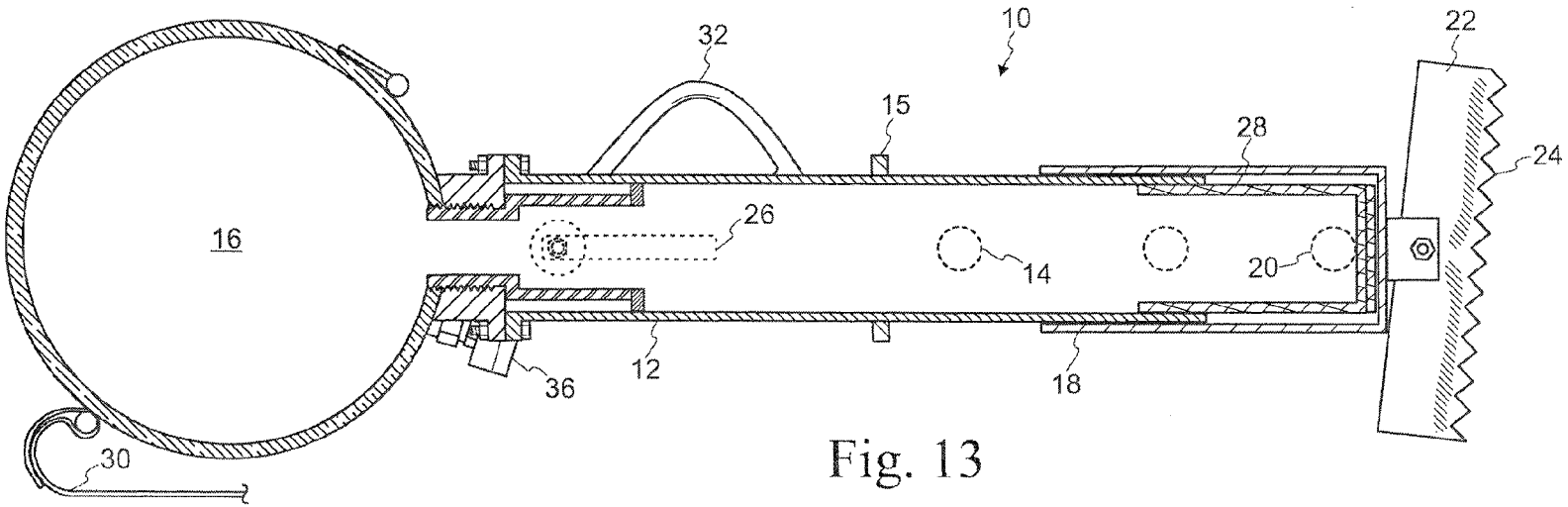
FIG. 13 is a right side cross-sectional view of the battering ram of FIG. 1, shown in a deployed position.

The novel features believed characteristic of the invention are set forth in the appended claims. The invention will best be understood by reference to the following detailed description of illustrated embodiments when read in conjunction with the accompanying drawings, wherein like reference numerals and symbols represent like elements.

Referring to FIGS. 1-16, a battering ram, hereinafter referred to as battering ram 10, is shown. The battering ram 10 comprises a housing. 12, a pressurized air tank 16, a ramming head 18, and a ramming edge 22 pivotably coupled to the ramming head 18.

The battering ram 10 has a housing 12 that is cylindrical. A pressurized air tank 16 is coupled to a proximal end of the housing 12. In one embodiment, the pressure of the air inside the pressurized air tank 16 is approximately 150 psi, but it should be clearly understood that substantial benefit may be derived from the air being at a different suitable pressure level. Though not required, the pressurized air tank 16 will preferably have a pressure gauge 36 for reading the pressure inside the air tank 16 and will have a check valve 38 (shown in FIGS. 2, 4, 6) for refilling the pressurized air tank 16.

The ramming head 18 is slidably coupled to a distal end of the housing 12. The ramming head 18 is shown as sliding over the housing 12 until it abuts an annular flange 15 defined by the housing 12. It should be clearly understood, however, that substantial benefit may be derived from a housing 12 that does not have an annular flange 15. The ramming head 18 is shown as defining apertures 20. These apertures 20 align with apertures 14 (shown in FIGS. 5-7, 11, and 13) defined by the housing 12. During operation of the battering ram 10, excess air may be released through these apertures 14, 20. This helps to control the force of the ramming head 18. While it is shown that the housing 12 and the ramming head 18 define two apertures 14, 20 each, it should be clearly understood that substantial benefit may be derived from the use of a different number of apertures 14, 20 or none at all.

The ramming head 18 is shown as having a ramming edge 22 coupled to its distal end. The ramming edge 22 is shown as having a plurality of teeth 24 for gripping and penetrating the target enclosure 40 (shown in FIG. 14). The teeth 24 may be of uniform length or they may have different lengths (see FIGS. 2 and 14). It should also be clearly understood that substantial benefit may be derived from a ramming edge 22 not having any teeth 24 and, instead, having a flat or tapered end. The ramming edge 22 is preferably pivotably coupled to the ramming head 18. A hinge assembly 11 (see FIG. 1) connects the ramming edge 22 to the ramming head 18 and will allow the ramming edge 22 to rest flush against the enclosure 40 despite a user 34 (shown in FIG. 14) being too tall or too short or despite the user 34 having to stand at a level higher or lower than the enclosure 40 (e.g. on stairs). In one embodiment (see FIGS. 4, 10, and 11), the ramming edge 22 is coupled to the ramming head 18 with a bolt assembly 13. The bolt assembly 13 has two spaced apart plates 46 coupled to a distal end 48 of the ramming head 18 and each plate 46 defines an aperture 47. A bolt 50 passes through the aperture 47 of each plate 46 and through an aperture 53 defined by a middle portion 52 of the ramming edge 22, and a nut 54 to secure the bolt 50 in place. While this hinge assembly 11 is preferred, it should be clearly understood that other hinge assemblies 11 may be used and substantial benefit may nevertheless be obtained from the ramming edge 22 being fixedly coupled to the ramming head 18.

In one embodiment, the battering ram 10 will have a slug 28 (shown in FIGS. 5-9 and 11-13) dimensioned to be inserted into the housing 12 proximate the pressurized air tank 16. The slug 28 is shown as being cylindrical with one open end and one closed end, however, it should be clearly understood that substantial benefit may be derived from the slug 28 being solid and circular. When air is released from the pressurized air tank 16, the slug 28 will be forced outward against an inner surface of the ramming head 18, thus forcing the ramming head 18 outward toward the enclosure 40.

In another embodiment, a slug 28 will not be used. There will be an airtight seal between the ramming head 18 and the housing 12 and the air released from the pressurized air tank 16 will force the ramming head 18 outwardly toward the enclosure 40.

The battering ram 10 may have a handle 32 that the user 34 may grip to hold the battering ram 10 steady during use. The battering ram 10 may also have one or more harnesses 30 to strap the battering ram 10 to the body of the user 34. This will also help the user 34 in carrying the battering ram 10 and keeping it steady during use. It should be clearly understood that substantial benefit may still be derived from the battering ram 10 having no handle 32 or harnesses 30.

Figure 15:
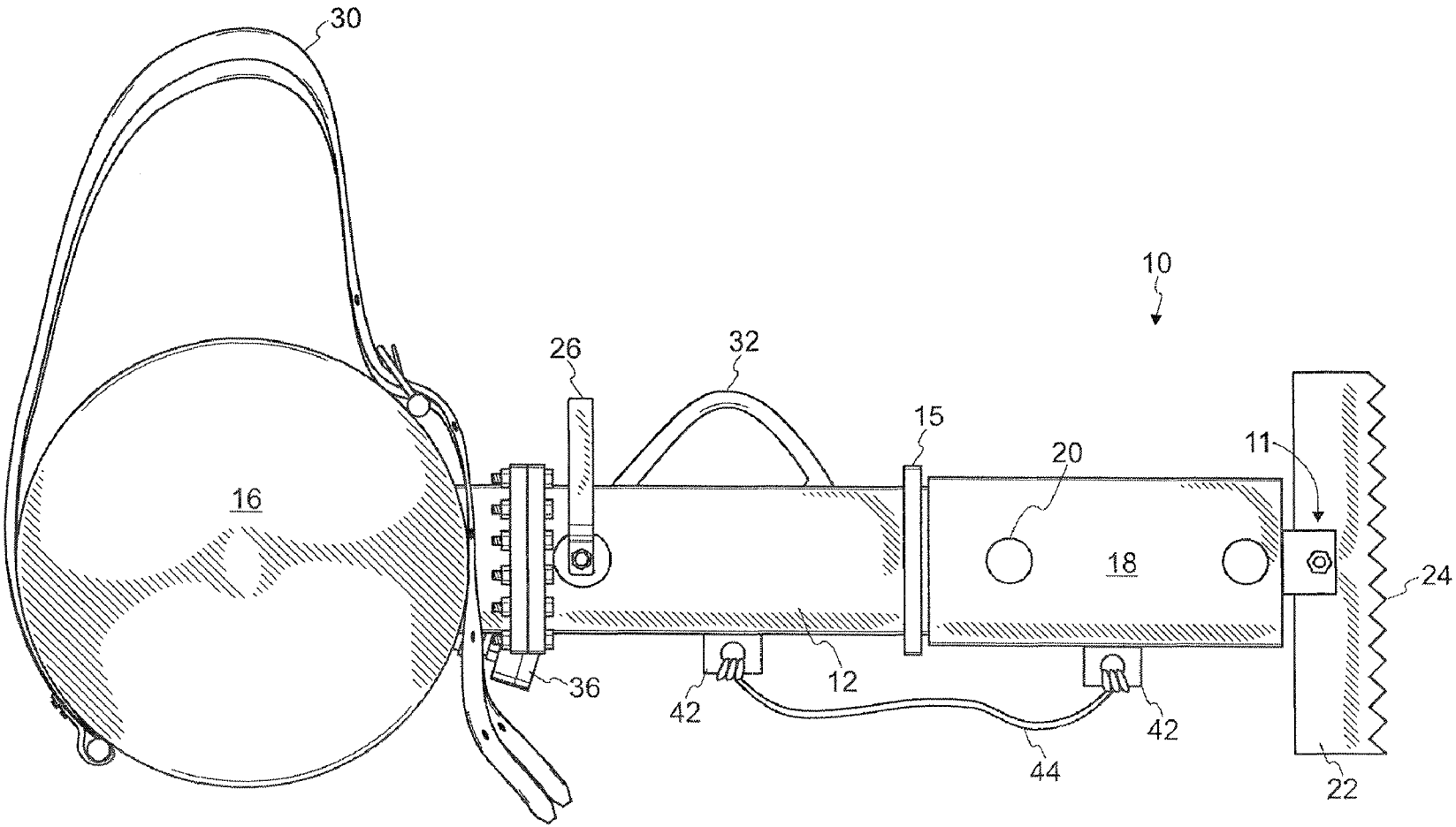
FIG. 15 is a side view of the battering ram of FIG. 1 shown with a restraint strap.
Figure 16:
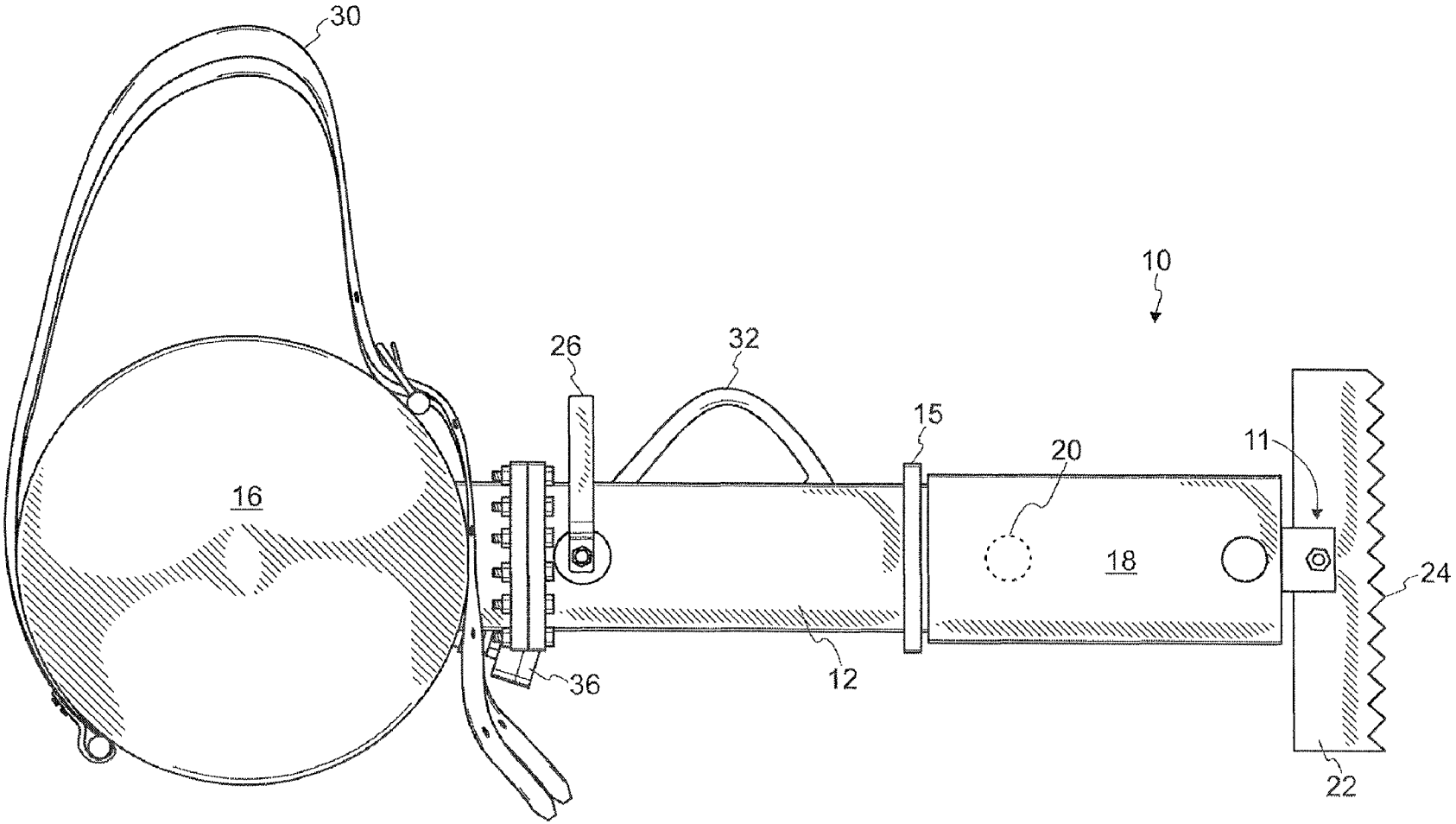
FIG. 16 is a side view of the battering ram of FIG. 1 shown with one of the apertures of the ramming head and the annular flange in phantom lines.

As shown in FIG. 15, the battering ram 10 may also have at least one restraint strap 44. In one embodiment, a mount 42 defining an aperture is coupled to the housing 12 and another mount 42 defining an aperture is coupled to the ramming head 18. Each end of the strap 44 will be coupled to one of the apertures of the mounts 42. The strap 44 may be made of nylon or any other suitable material. The strap 44 will provide enough slack to allow the ramming head 18 to slide outward approximately 4-5 inches and will prevent the ramming head 18 from sliding completely off of the housing 12. The strap 44 may be removable or may be permanently coupled to the mounts 42. The battering ram 10 may have any number of restraint straps 44 and it should be clearly understood that substantial benefit may still be obtained if there are no restraint straps 44 on the battering ram 10.

Statement of Use

Figure 14:
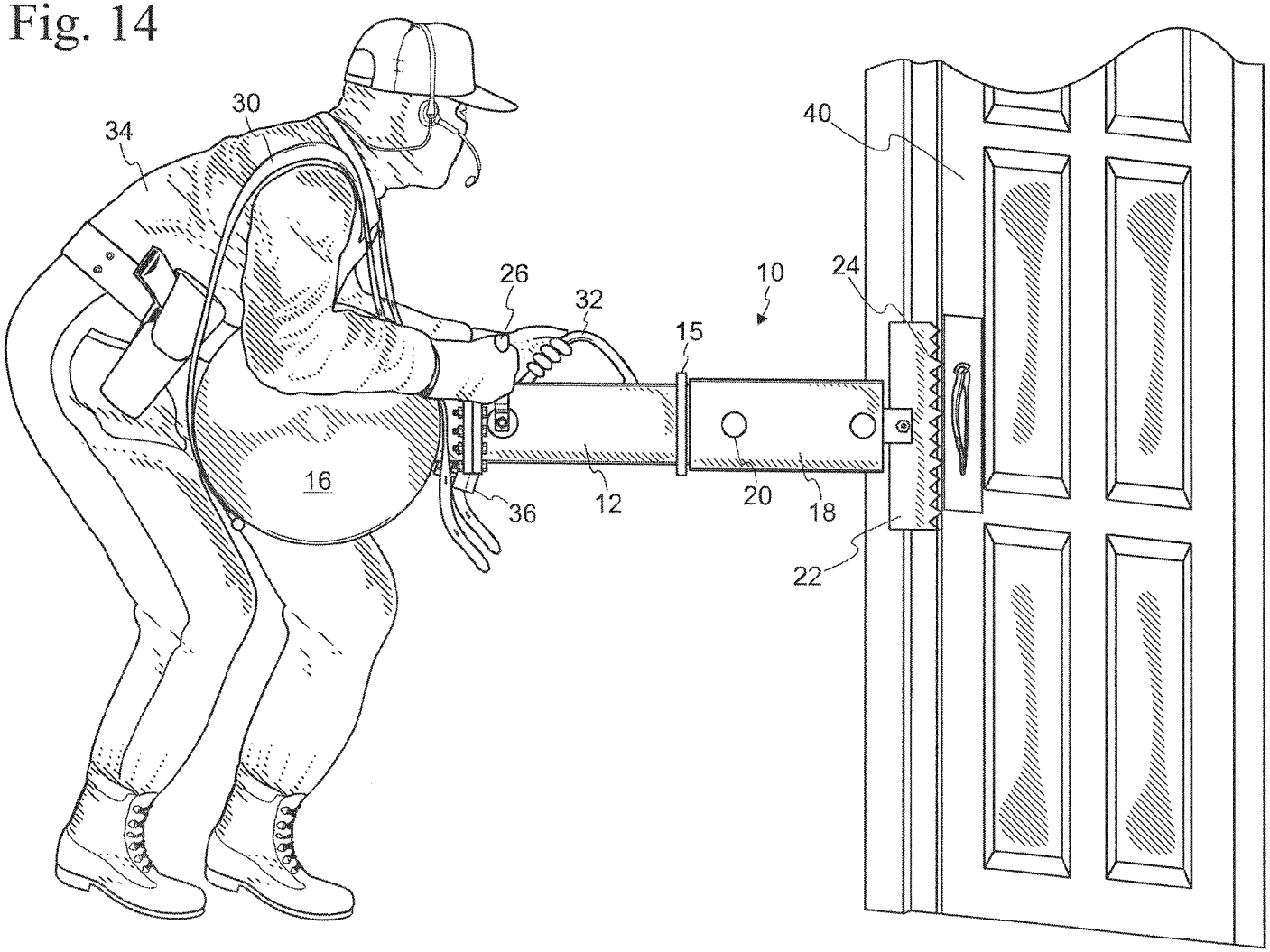
FIG. 14 is a side view of the battering ram of FIG. 1 shown in use by a law enforcement officer.

One way to forcibly open an enclosure 40, such as the door depicted in FIG. 14, is to use an embodiment of the battering ram 10 of the present invention. A user 34 may use the harnesses 30 to strap the battering ram 10 to his/her shoulders. The user 34 may then insert a slug 28 into the housing 12 proximate the pressurized air tank 16. The user 34 will then slide the ramming head 18 onto the distal end of the housing 12 until it abuts the annular flange 15 defined by the housing 12. The user 34 may then align the apertures 20 defined by the ramming head 18 with the apertures 14 defined by the housing 12.

The user 34 may grip the handle 32 and will position the ramming edge 24 against the enclosure 40. In the case of a door, the user 34 will place the ramming edge 22 inwardly from the door lock or dead bolts. The user 34 may also place the ramming edge 22 on the opposite side of the door to blow out the door hinges. The user 34 will then throw the release lever 26 to release air from the pressurized air tank 16 into the housing 12. If the user 34 had used a slug 28, the slug 28 will be forced outwardly and will strike an interior surface of the ramming head 18. The ramming head 18 will then be forced outwardly toward the enclosure 40. Excess air from the housing 12 will be released through the apertures 14, 20.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A battering ram comprising:

a housing;

a pressurized air tank coupled to one end of the housing;

a ramming head slidably coupled to the other end of the housing;

a ramming edge pivotably coupled to the ramming head; and a hinge mechanism connecting the ramming edge to the ramming head for allowing the ramming edge to remain flush against an enclosure when the housing is held at varying angles relative to the enclosure;

wherein the hinge mechanism comprises:

two spaced apart plates coupled to a distal end of the ramming head, each plate defining an aperture;

a bolt passing through the aperture of each plate and through an aperture defined by a middle portion of the ramming edge; and a nut to secure the bolt in place.

2. The battering ram of claim 1 further comprising a plurality of teeth along a distal side of the ramming edge for penetrating the enclosure.

3. The battering ram of claim 1 wherein the ramming head defines at least one aperture that aligns with at least one aperture defined by the housing.

4. The battering ram of claim 1 further comprising a release lever coupled to the housing for releasing air from the pressurized air tank into the housing.

5. The battering ram of claim 1 further comprising a slug within the housing that slides along the length of the housing and forces the ramming head outward when air is released from the pressurized air tank into the housing against the slug.

6. The battering ram of claim 1 further comprising at least one harness coupled to the battering ram for strapping the battering ram to the body of a user.

7. The battering ram of claim 1 further comprising at least one restraint strap coupled at one end to the housing and coupled at the other end to the ramming head.

8. A pneumatic battering ram comprising:

a cylindrical housing;

a pressurized air tank coupled to a proximal end of the housing;

a cylindrical slug within the housing that slides along the length of the housing;

a cylindrical ramming head slidably coupled to a distal end of the housing;

a rectangular ramming edge pivotably bolted to a distal end of the ramming head, wherein a distal side of the ramming edge has a plurality of teeth for penetrating the enclosure; and a bolt assembly coupling a middle portion of the ramming edge perpendicularly to the ramming head, wherein the bolt assembly comprises:

two spaced apart plates coupled to the distal end of the ramming head, each plate defining an aperture;

a bolt passing through the aperture of each plate and through an aperture defined by the middle portion of the ramming edge; and a nut to secure the bolt in place.

9. The battering ram of claim 8 wherein pressure within the pressurized air tank is approximately 150 psi.

10. The battering ram of claim 9 wherein the slug weighs approximately five pounds.

11. The battering ram of claim 8 wherein the ramming head defines at least one aperture that aligns with at least one aperture defined by the housing.

12. The battering ram of claim 8 further comprising two shoulder harnesses coupled to the pressurized air tank for strapping the battering ram to the body of a user.

13. The battering ram of claim 8 further comprising a release lever coupled to the housing for releasing air from the pressurized air tank into the housing.

14. The battering ram of claim 8 further comprising at least one restraint strap coupled at one end to the housing and coupled at the other end to the ramming head.

15. A pneumatic battering ram comprising:

a housing;

a pressurized air tank coupled to one end of the housing;

a ramming head slidably coupled to the other end of the housing;

a ramming edge pivotably bolted to the ramming head;

a slug within the housing that slides along the length of the housing;

at least one aperture defined by the ramming head that aligns with at least one aperture defined by the housing for releasing excess air from the housing when air is released from the air tank and the slug slides toward the ramming head; and a bolt assembly for pivotably coupling a middle portion of the ramming edge perpendicularly in relation to the ramming head, wherein the bolt assembly allows the ramming edge to remain flush against an enclosure when the housing is held at varying angles relative to the enclosure, and wherein the bolt assembly comprises:

two spaced apart plates coupled to a distal end of the ramming head, each plate defining an aperture;

a bolt passing through the aperture of each plate and through an aperture defined by the middle portion of the ramming edge; and a nut to secure the bolt in place.

16. The battering ram of claim 15 wherein the ramming edge is rectangular and has a plurality of teeth along a distal side of the ramming edge.

17. The battering ram of claim 15 further comprising two shoulder harnesses coupled to the pressurized air tank for strapping the battering ram to the body of a user.

18. The battering ram of claim 15 further comprising two restraint straps coupled at one end to the housing and coupled at the other end to the ramming head.

* * * * *